US007063518B2

(12) United States Patent
Skinner et al.

(10) Patent No.: US 7,063,518 B2
(45) Date of Patent: Jun. 20, 2006

(54) BEARING SUPPORT AND STATOR ASSEMBLY FOR COMPRESSOR

(75) Inventors: Robin G Skinner, Tecumseh, MI (US); Dale Westcott, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 410 days.

(21) Appl. No.: 10/617,475

(22) Filed: Jul. 11, 2003

(65) Prior Publication Data

US 2005/0008507 A1 Jan. 13, 2005

(51) Int. Cl.
*F04B 17/00* (2006.01)
*F04B 35/04* (2006.01)

(52) U.S. Cl. ..... 417/410.1; 417/410.5; 310/90; 310/217

(58) Field of Classification Search ..... 417/410.5, 417/423.7, 423.15; 418/55.1; 310/90, 217, 310/91

See application file for complete search history.

(56) References Cited

U.S. PATENT DOCUMENTS

| | | | | |
|---|---|---|---|---|
| 2,792,512 A | | 5/1957 | Koch | 310/258 |
| 3,200,275 A | | 8/1965 | Lindgren | 310/90 |
| 4,137,014 A | | 1/1979 | Parker | 417/326 |
| 4,186,319 A | * | 1/1980 | Dochterman | 310/89 |
| 4,306,168 A | | 12/1981 | Peachee | 310/217 |
| 4,552,518 A | | 11/1985 | Utter | 418/55 |
| 4,900,238 A | | 2/1990 | Shigemi et al. | 417/410 |
| 4,940,396 A | | 7/1990 | Shimiu et al. | 417/410 |
| 5,043,616 A | | 8/1991 | Katsuzawa et al. | 310/91 |
| 5,391,066 A | | 2/1995 | Sawai et al. | 418/55.6 |
| 5,474,433 A | | 12/1995 | Chang et al. | 418/55.4 |
| 5,487,213 A | | 1/1996 | Hult et al. | 29/596 |
| 5,531,577 A | | 7/1996 | Hayase et al. | 418/55.1 |
| 5,580,233 A | | 12/1996 | Wakana et al. | 418/94 |
| 5,660,539 A | | 8/1997 | Matsunaga et al. | 418/55.6 |
| 5,929,545 A | | 7/1999 | Fargo | 310/89 |
| 5,952,751 A | | 9/1999 | Yamakoshi et al. | 310/89 |
| 6,023,838 A | | 2/2000 | Yamakoshi et al. | 29/596 |
| 6,027,321 A | | 2/2000 | Shim et al. | 418/1 |
| 6,050,794 A | | 4/2000 | Noboru et al. | 418/55.6 |
| 6,056,523 A | | 5/2000 | Won et al. | 418/15 |
| 6,223,416 B1 | | 5/2001 | Boyd, Jr. et al. | 29/596 |
| 6,264,446 B1 | | 7/2001 | Rajendran et al. | 418/55.6 |
| 6,280,154 B1 | | 8/2001 | Clendenin et al. | 417/410.5 |

* cited by examiner

*Primary Examiner*—Charles G. Freay
*Assistant Examiner*—Samuel E. Belt
(74) *Attorney, Agent, or Firm*—Baker & Daniels

(57) ABSTRACT

A compressor assembly including a compression mechanism, a motor including rotor and a laminated stator and a shaft is provided. The shaft is operably coupled to the compression mechanism and the rotor. The shaft extends outwardly from the motor opposite the compression mechanism. A bearing support has a central body that rotatably supports an end of the shaft. The bearing support also includes an outer ring and a support structure connecting the outer ring and central body. The outer ring has a plurality of circumferentially distributed bearing surfaces separated by recesses and bears against the laminated stator. Deformations in the laminations of the stator are received in the recesses in the outer ring. A method of supporting a shaft in a compressor wherein a bearing support member bears against a laminated stator and a stator lamination deformingly protrudes into a recess on the bearing support is also provided.

16 Claims, 10 Drawing Sheets

BEARING SUPPORT AND STATOR ASSEMBLY FOR COMPRESSOR

BACKGROUND OF THE INVENTION

1. Field of the Invention

The present invention relates to compressors and, more particularly, to bearing supports for the drive shaft used with a compressor assembly including an electrical motor having a laminated stator.

2. Description of the Related Art

Compressors generally include a compression mechanism for compressing a vapor and a motor for driving the compression mechanism. Both the compression mechanism and the motor are typically hermetically enclosed within a housing. Several different types of compression mechanisms are in common use including scroll, rotary, and reciprocating mechanisms. The compression mechanism is typically driven by the rotating crankshaft of an electrical motor. The crankshaft typically extends through the motor and has an end that protrudes from the motor and is supported by a bearing.

The motor commonly includes a laminated stator and a rotor with the crankshaft being operably coupled to the rotor. A bearing support or outboard bearing for rotatably supporting the end of the crankshaft is typically located on the end of the motor opposite the compressor mechanism. The outboard bearing may have a mounting face which bearingly abuts the laminated stator.

The stator is commonly made of sheet metal laminations or layers, stacked atop one another. Although the laminations of such stators may be securely interconnected, when a compressive load is placed on the laminations forming the opposite ends of the stator, such as by the mounting of bearing supports on opposite ends of the stator, bulges or other deformations may be formed in the end surfaces of the stator which, in turn, may cause the displacement or deformation of the bearing support that has a mounting face abutting the laminations.

SUMMARY OF THE INVENTION

The present invention provides a compressor assembly that has a bearing support that bearingly engages a laminated stator and includes recesses in its bearing surface to accommodate the bulges that may be formed in the stator laminations to thereby avoid the displacement or deformation of the bearing support that may result from the deformation of the stator laminations.

The present invention comprises, in one form thereof, a compressor assembly that includes a compression mechanism, a motor having a rotor and a stator, a shaft, and a bearing support. The stator has a plurality of stacked laminations. The shaft has a first end and an opposite second end wherein the first end is operably coupled to the compression mechanism. The shaft extends through the motor and is operably coupled to the rotor. The second end extends outwardly from the motor opposite the compression mechanism. The bearing support has a central body rotatably supporting the second end of said shaft, an outer ring and a support structure connecting the central body and the outer ring. The outer ring has a plurality of circumferentially distributed bearing surfaces lying in a common plane. The bearing surfaces compressively abut a first end of the stator and a plurality of recesses are positioned between the circumferentially distributed bearing surfaces whereby the recesses are positioned to receive deformations formed in the stator by compressive forces applied to the stator by the distributed bearing surfaces.

In further embodiments of the invention, the outer ring of the bearing support may define a plurality of holes with a plurality of fasteners extending through the holes and compressively biasing the outer ring against the stator. The assembly may also include a crankcase abuttingly engaging the stator opposite the bearing support wherein the bearing support and the crankcase compressively engage the stator therebetween with the fasteners securing the crankcase to the bearing support. The crankcase is positioned to rotatably support the shaft between the compressor mechanism and the motor. The stator may include a plurality of stator openings in alignment with the plurality of holes in the outer ring with the fasteners extending through the stator openings. Alternatively, the fasteners may be positioned radially outwardly of the stator.

The support structure may take the form of a plurality of support arms extending from the central body to the outer ring. A bearing is mounted in the central body and rotatably supports the shaft. The assembly may also include a housing defining an interior plenum wherein the compression mechanism, the motor, the shaft and the bearing support are disposed within the interior plenum and a portion of the housing forms a cylindrical wall securely engaged with the outer ring. The outer ring may have a substantially cylindrical outer perimetrical edge that is securely engaged with the cylindrical wall.

The present invention comprises, in another form thereof, a method of supporting a shaft in a compressor. The method includes providing a motor having a laminated stator and a rotor and operably coupling a shaft with the rotor wherein the shaft has a first end and an opposite second end. A compressor mechanism is operably coupled to the first end of the shaft and a bearing support member having a central body and a plurality of circumferentially distributed bearing surface lying in a common plane and a plurality of recesses positioned between said circumferentially distributed bearing surfaces is provided. The method also includes rotatably supporting the shaft within the central body of the bearing support and compressively engaging one end of the laminated stator with the plurality of circumferentially distributed bearing surfaces wherein at least one stator lamination at least partially deformingly protrudes into at least one of the recesses.

In some embodiments of the invention, the step of compressively engaging one end of the laminated stator with the plurality of circumferentially distributed bearing surfaces includes positioning a crankcase against an opposite end of the stator, inserting a plurality of fasteners through the outer ring and engaging the crankcase with the fasteners. The method may also include rotatably supporting the shaft with a bearing mounted in the crankcase between the motor and the compressor mechanism. The method may also include disposing the compressor mechanism, motor and bearing support within a housing having a cylindrical wall wherein the bearing support is mounted within the housing by engaging a radially outer surface of the outer ring with the cylindrical wall. The bearing support may be positioned to support the second end of the shaft.

An advantage of the present invention is that it provides a bearing support for a compressor asssembly that may securely and bearingly engage the end surface of a laminated stator without having deformations formed in the stator displace or deform the bearing support.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
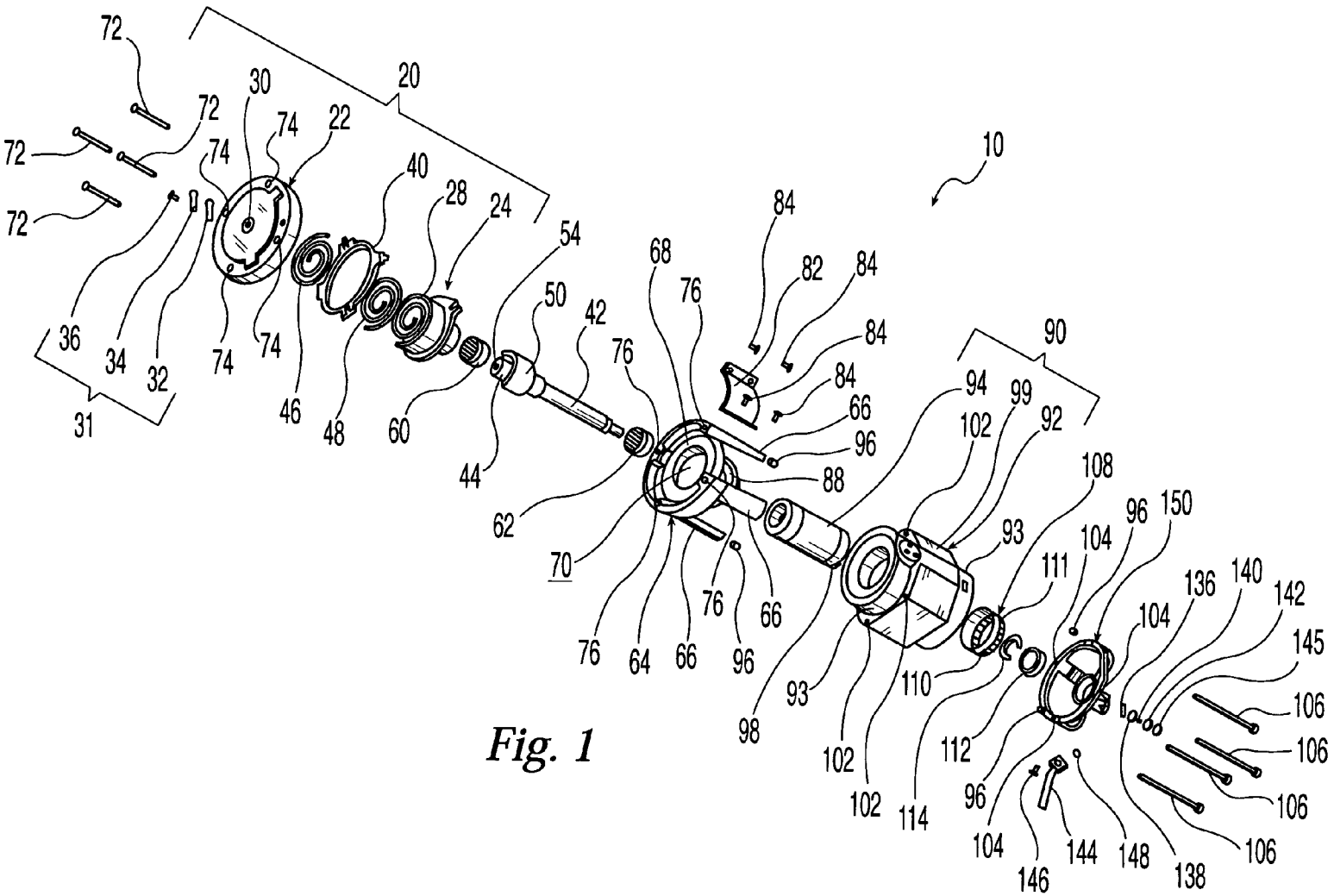
FIG. 1 is an exploded view of a scroll compressor in accordance with the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed. Rather the embodiments are chosen and described so that others skilled in the art may utilize its teachings.

DESCRIPTION OF THE PRESENT INVENTION

Figure 2:
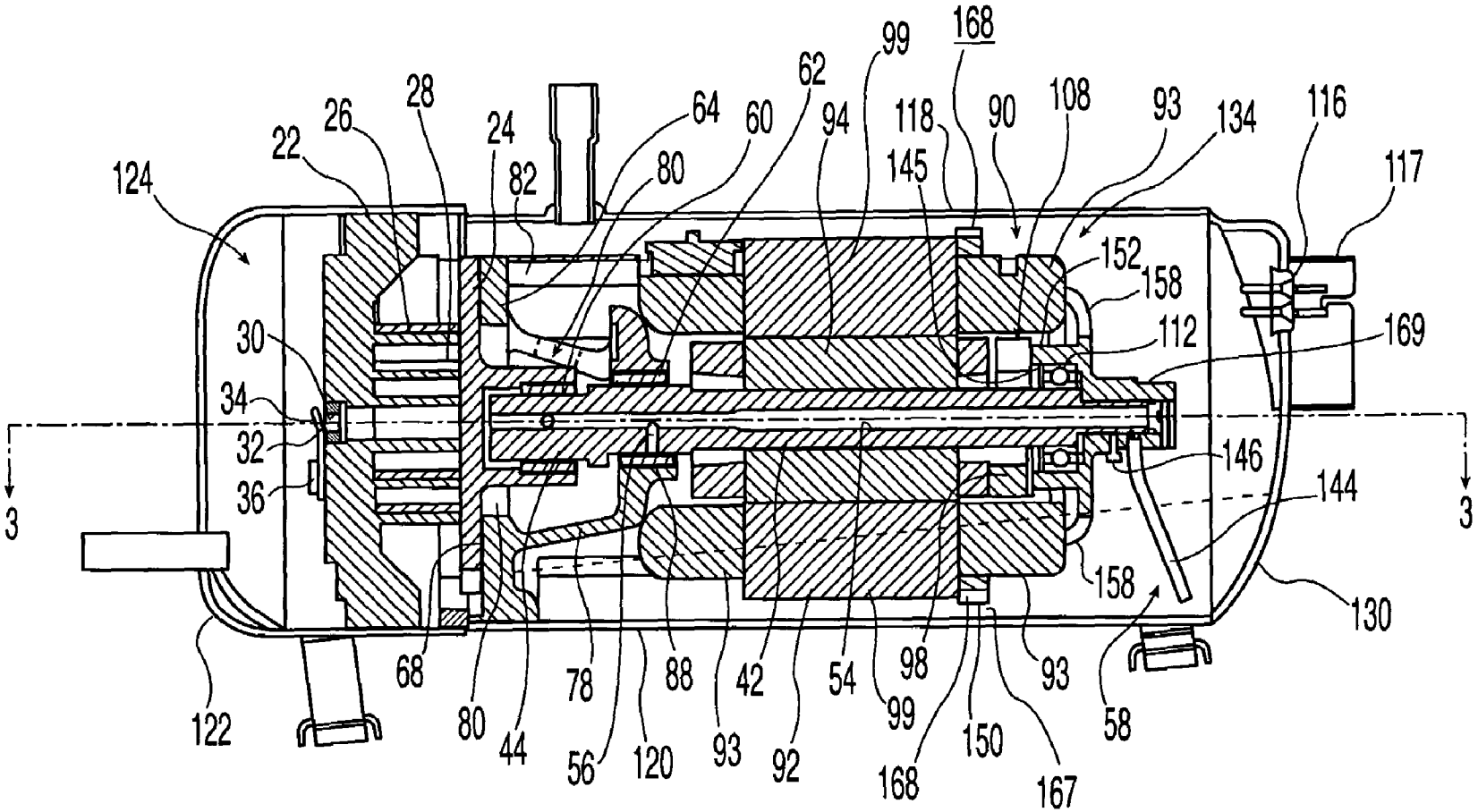
FIG. 2 is a sectional view of the compressor of FIG. 1.
Figure 3:
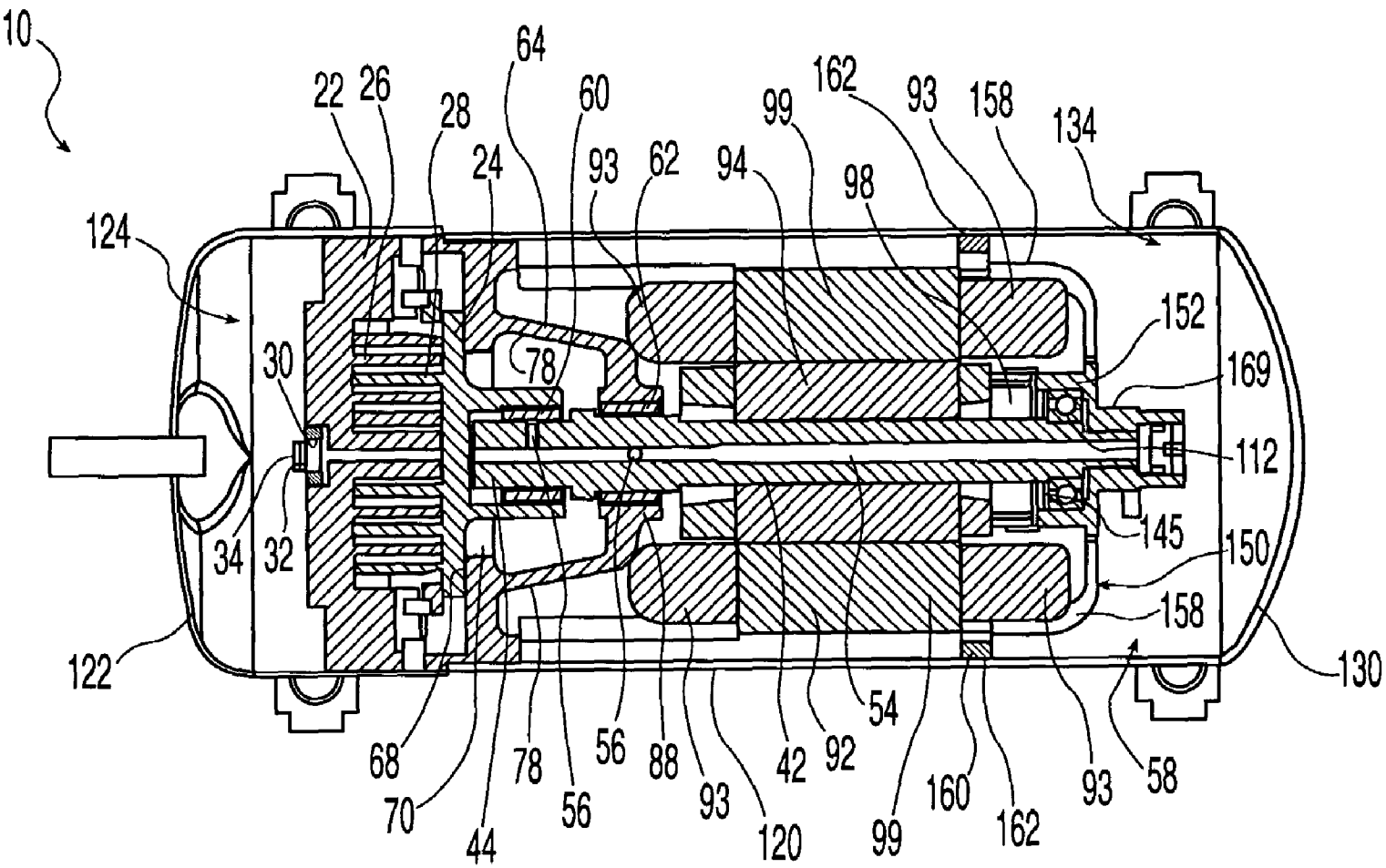
FIG. 3 is a sectional view of the compressor of FIG. 2 taken along lines 3–3.

In accordance with the present invention, a scroll compressor 10 is shown in FIGS. 1–3. Scroll compressor 10 generally includes compression mechanism 20 and motor 90, both of which are sealed within the interior or plenum of housing 118. Housing 118 includes cylindrical shell 120 and pair of end caps 122 and 130, which together define the interior plenum. The interior plenum of housing 118 includes low pressure plenum 134 and high pressure or discharge plenum 124, both of which are further described below.

As illustrated in FIGS. 1–3, compression mechanism 20 includes fixed or stationary scroll member 22 and orbiting scroll member 24. Fixed and orbiting scroll members 22, 24 include base plates from which involute wraps 26, 28 respectively extend. Involutes 26, 28 engage one another in a meshed arrangement to form evolving crescent-shaped pockets in a manner well known in the art. Carbon steel tip seals 46, 48 are mounted on the tips of involutes 26, 28 and provide a seal between involutes 26, 28 and the base plates of the opposite scroll member. Oldham ring 40 is disposed between fixed scroll member 22 and orbiting scroll member 24 to control the relative motion therebetween in a known manner. A discharge port 30 is defined in the base plate of fixed scroll member 22 and communicates refrigerant from the working space located at the center of involutes 26, 28 between fixed scroll member 22 and orbiting scroll member 24 to discharge plenum 124 defined between scroll member 22 and end cap 122. A discharge plenum configuration that may be used with the present invention is described in U.S. Provisional Patent Application Ser. No. 60/412,871 entitled COMPRESSOR DISCHARGE ASSEMBLY filed on Sep. 23, 2003, which is hereby incorporated herein by reference.

As illustrated in FIGS. 1–3, one-way valve 31 is mounted on fixed scroll member 22 at discharge port 30 to prevent refrigerant from re-entering discharge port 30 from discharge plenum 124. Valve 31 includes resilient valve leaf 32 and rigid valve retainer 34, both of which are mounted on fixed scroll member 22 by valve fastener 36. Valve leaf 32 sealingly engages scroll member 22 at discharge port 30 and is deflected outwardly away from discharge port 30 when a certain pressure is reached within the center of involutes 26, 28 between scroll members 22, 24. To prevent excessive flexing of valve 32, valve retainer 34 is mounted adjacent valve leaf 32 and serves to limit the extent to which valve leaf 32 deflects outwardly from discharge port 30. Valve retainer 34 includes a bend at its distal end, which allows valve leaf 32 to flex outward a limited distance from discharge port 30. Fastener 36 is used to secure valve leaf 32 and retainer 34 to fixed scroll 22. Discharge valves that may be used with the present invention are described by Haller, et al. in U.S. Provisional Application Ser. No. 60/412,905 entitled COMPRESSOR HAVING DISCHARGE VALVE filed on Sep. 23, 2003, which is hereby incorporated herein by reference.

Orbiting scroll 24 is mounted on roller bearing 60 which is positioned on an eccentrically positioned extension 44 of shaft 42. As shaft 42 rotates, orbiting scroll 24 moves in an orbital path relative to fixed scroll 22 due to the motion of eccentric extension 44 and engagement of Oldham ring 40. A counterweight 50 is provided on shaft 42 to counterbalance the eccentric loading of orbiting scroll 24 on shaft 42. As illustrated in FIGS. 1 and 3, shaft 42 includes primary internal passage 54, extending the longitudinal length of shaft 42 and secondary internal passages 56, extending transversely from passage 54 to the radial outer surface of shaft 46. Passages 54, 56 communicate lubricating oil between oil sump 58, which is located within housing 118, and roller bearings 60, 62, which rotatably engage shaft 42 at orbiting scroll 24 and crankcase 64, respectively.

Referring now to FIGS. 1, 2, 4 and 5, crankcase 64 is secured to fixed scroll 22 with threaded fasteners 72, which extend through openings 74 in fixed scroll 22 and engage threaded bores 76 in crankcase 64. Crankcase 64 includes a thrust surface 68, which slidably engages orbiting scroll 24 and restricts movement of orbiting scroll 24 away from fixed scroll 22. Crankcase 64 includes a central bore 70 through which shaft 42 extends, and four legs 66 extending outwardly from crankcase 64. Threaded openings 100 are provided in legs 66 and may include a smooth bore portion. As shown in FIG. 2, crankcase 64 also includes shroud portion 78 disposed between legs 66 and partially enclosing a space in which counterweight 50 rotates. Shroud 78 includes opening 80 along its upper portion, which permits the equalization of pressure between the space partially enclosed by shroud 78 and the remainder of the low pressure plenum 134. Low pressure plenum 134 includes that space within compressor housing 118, located between orbiting scroll 24 and end cap 130. Turning to FIGS. 1 and 2, suction baffle 82 is secured between two legs 66 of crankcase 64 using baffle fasteners 84. Baffle fasteners 84 may be any suitable fastener, such as, socket head cap screws, self-tapping screws, and other known fasteners. In addition, alternative fastening methods may also be used to secure suction baffle 82 to legs 66 of crankcase 64. Crankcase 64 includes a sleeve portion 88 which is supported by shroud portion 78 opposite central bore 70 and in which roller bearing 62 is mounted for rotatably supporting shaft 46. Alternative crankcases and suction baffles which may be used with compressor 20 are described by Haller, et al. in U.S. Provisional Application Ser. No. 60/412,768 entitled COMPRESSOR ASSEMBLY filed on Sep. 23, 2002, which is hereby incorporated herein by reference.

Figure 11:
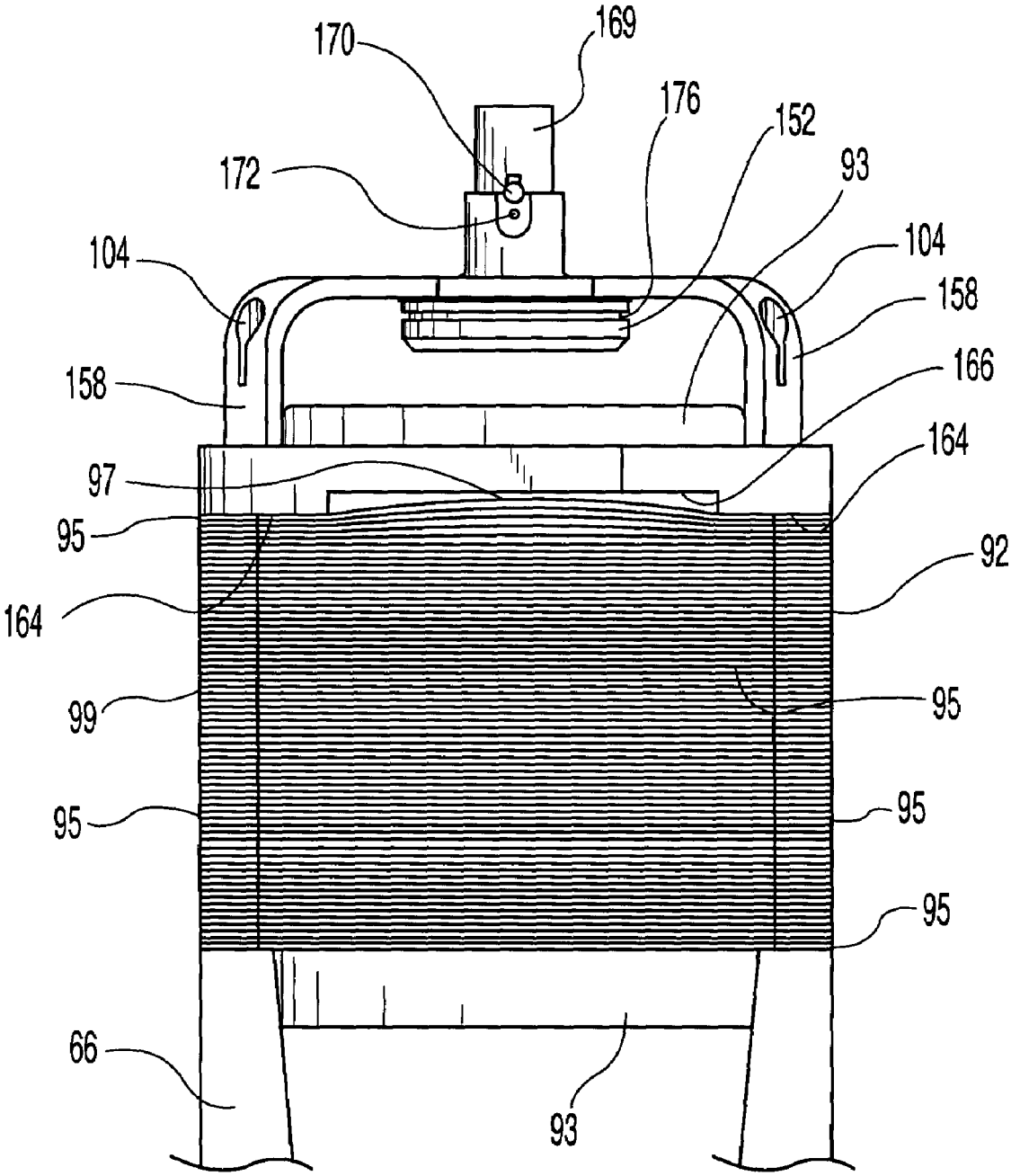
FIG. 11 is a side view of an outboard bearing/stator/crankcase assembly according to one embodiment of the present invention.

As illustrated in FIGS. 1–3, motor 90 is disposed adjacent crankcase 64 and includes stator 92 and rotor 94. Shaft 42 extends through the bore of rotor 94 and is rotationally secured thereto by a shrink-fit engagement. Rotor 94 also includes a counterweight 98 to facilitate the rotational balancing of the load placed on rotor 94. Stator 92 and rotor 94 operate in a conventional manner and drive the rotation of shaft 42 to power compression mechanism 20. Stator 92 includes windings 93 which are schematically represented in the Figures and stator core 99. As shown in FIG. 11, stator core 99 is comprised of individual stacked laminations or layers 95 which in the illustrated embodiment takes the form of an interlocked stack of sheet metal laminations. Referring back to FIGS. 1–3, illustrated stator core 99 includes holes 102 extending the length of core 99. Electrical power is supplied to stator 92 through internal wiring (not shown) connected to terminal pin cluster 116. A terminal guard 117 shields the external portion of terminal pin cluster 116. Shaft 42 extends through rotor 94 and stator 92 and the end of shaft 42 opposite scroll member 24 projecting from motor 90 is rotatably supported by bearing assembly 112 mounted within outboard bearing support 150.

Figure 9:
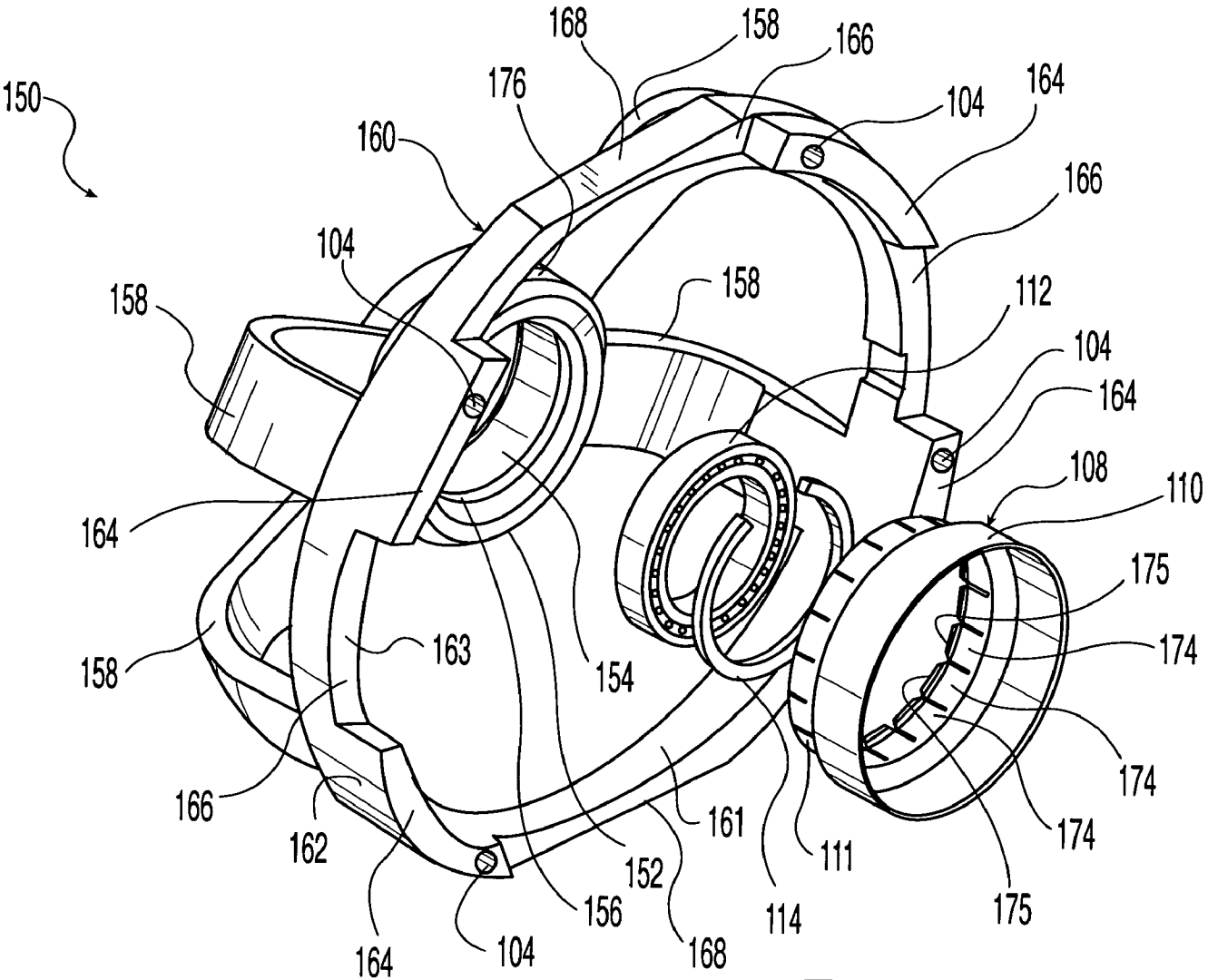
FIG. 9 is a perspective view of an outboard bearing assembly according to one embodiment of the present invention.

Turning to FIGS. 1–3 and 6–9, outboard bearing 150 is mounted to laminated core 99 of stator 92 and includes central body or boss 152, outer support ring 160 and support arms 158, which extend from central boss 152 to ring 160. Central boss 152 defines substantially cylindrical opening 154 and includes inner groove 156 and outer groove 176. Retaining ring 114 fits within inner groove 156 and retains ball bearing assembly 112 within opening 154. As shown in FIGS. 2, 3 and 9, oil shield 108 is secured to boss 152 includes has a first cylindrical portion 110 and second cylindrical portion 111. First cylindrical portion 110 extends towards motor 90. Counterweight 98 of rotor 94 is disposed within the space circumscribed by first cylindrical portion 110 of oil shield 108 which thereby inhibits the disturbance of oil in oil sump 58 from the fanning action of counterweight 98. Second cylindrical portion 111 of oil shield 108 has a smaller diameter than the first cylindrical portion 110 and includes a plurality of longitudinally extending tabs 174 each having a radially inwardly bent distal portion 175. Oil shield 108 is secured to central boss 152 by engaging the bent distal portions 175 of tabs 174 within outer groove 176. Oil shields which may be used with the present invention are described by Skinner in U.S. Provisional Application Ser. No. 60/412,838 entitled COMPRESSOR HAVING COUNTERWEIGHT SHIELD filed on Sep. 23, 2003 which is hereby incorporated herein by reference.

As shown in FIGS. 1–2 and 6–7, sleeve 169 projects rearwardly from central boss 152. Sleeve 169 includes opening 170 which is in fluid communication with oil pickup tube 144. Oil pickup tube 144 provides for uptake of lubricating oil from oil sump 58 and is secured to sleeve 169 by threaded fastener 146, which is received in threaded opening 172 of sleeve 169. O-ring 148 provides a seal between oil pickup tube 144 and sleeve 169. As shown in FIG. 1, vane 136, reversing port plate 138, pin 140, washer/wave spring assembly 142 and retaining ring 145 are secured within sleeve 169 near the end of shaft 42 and facilitate the communication of lubricating oil through sleeve 169.

Figure 10:
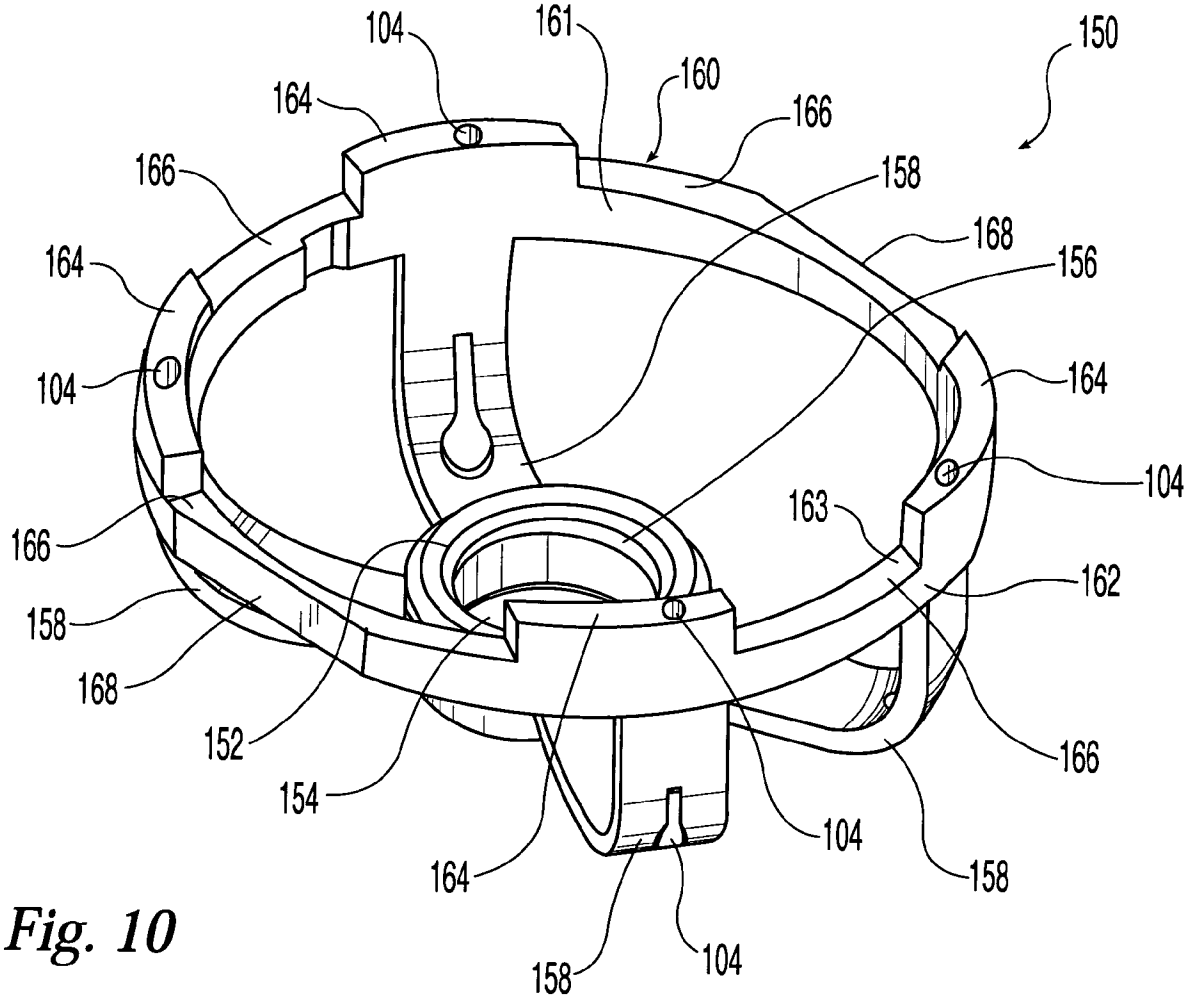
FIG. 10 is a perspective view of the outboard bearing of FIG. 9.

Referring to FIGS. 6–9, ring 160 includes annular mounting face 163, inner perimetrical edge 161 and substantially arcuate outer perimetrical edge 162 which in the illustrated embodiment is substantially cylindrical. Annular mounting face 163 includes alternating discreet bearing surfaces 164 and recesses 166 circumferentially distributed about mounting face 163. As illustrated in FIGS. 2, 3, and 11, a portion of stator windings 93 fit within ring 160 such that inner perimetrical edge 161 of ring 160 faces windings 93. Inner perimetrical edge 161 may include notch 165, which may be used to locate outboard bearing 150 during machining of outboard bearing 150 and which may also facilitate the equalization of pressure within low pressure plenum 134. Outer perimetrical edge 162 includes arcuate portions which are in secure engagement with housing 118. Outer perimetrical edge 161 includes flat portions 168 which are spaced apart from housing 118 to create passage 167 between housing 118 and ring 160 to thereby facilitate the flow of oil along the bottom surface of the compressor housing and the equalization of pressure within low pressure plenum 134. The use of such flats is described by Haller in U.S. Provisional Patent Application Ser. No. 60/412,890 entitled COMPRESSOR HAVING BEARING SUPPORT filed on Sep. 23, 2003 which is hereby incorporated herein by reference. Smooth bore pilot holes 104 are provided in ring 160 and extend through bearing surfaces 164. As shown in FIGS. 6–9, pilot holes 104 further extend through arms 158. Alternatively, pilot holes 104 may extend through a portion of ring 160 adjacent arms 158, as illustrated in FIGS. 10–11.

Figure 5:
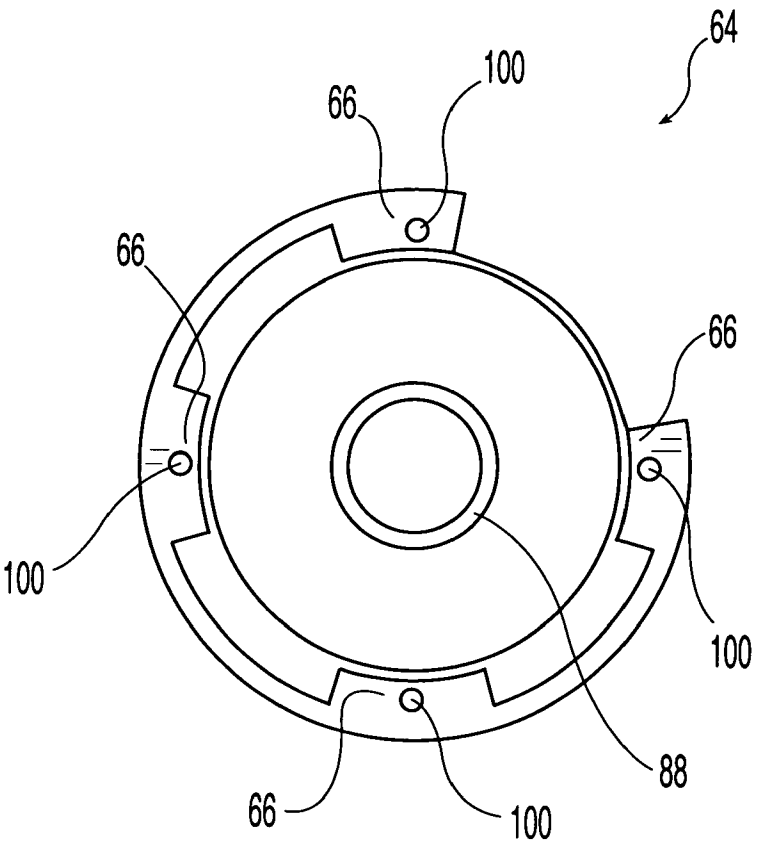
FIG. 5 is a bottom view of the crankcase of FIG. 4.
Figure 4:
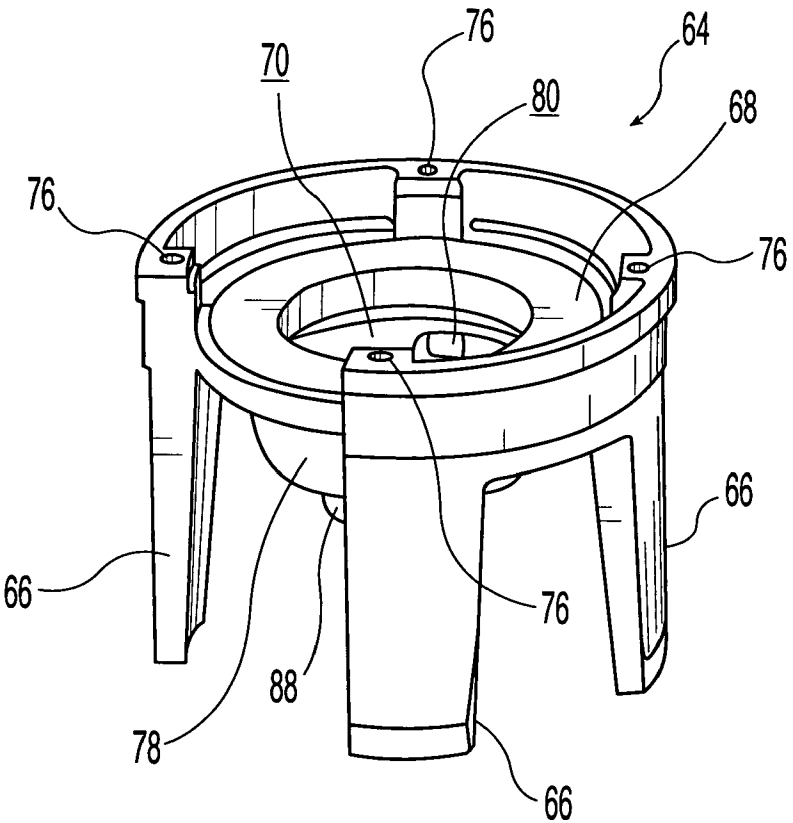
FIG. 4 is a perspective view of a crankcase of a compressor according to the present invention.
Figure 6:
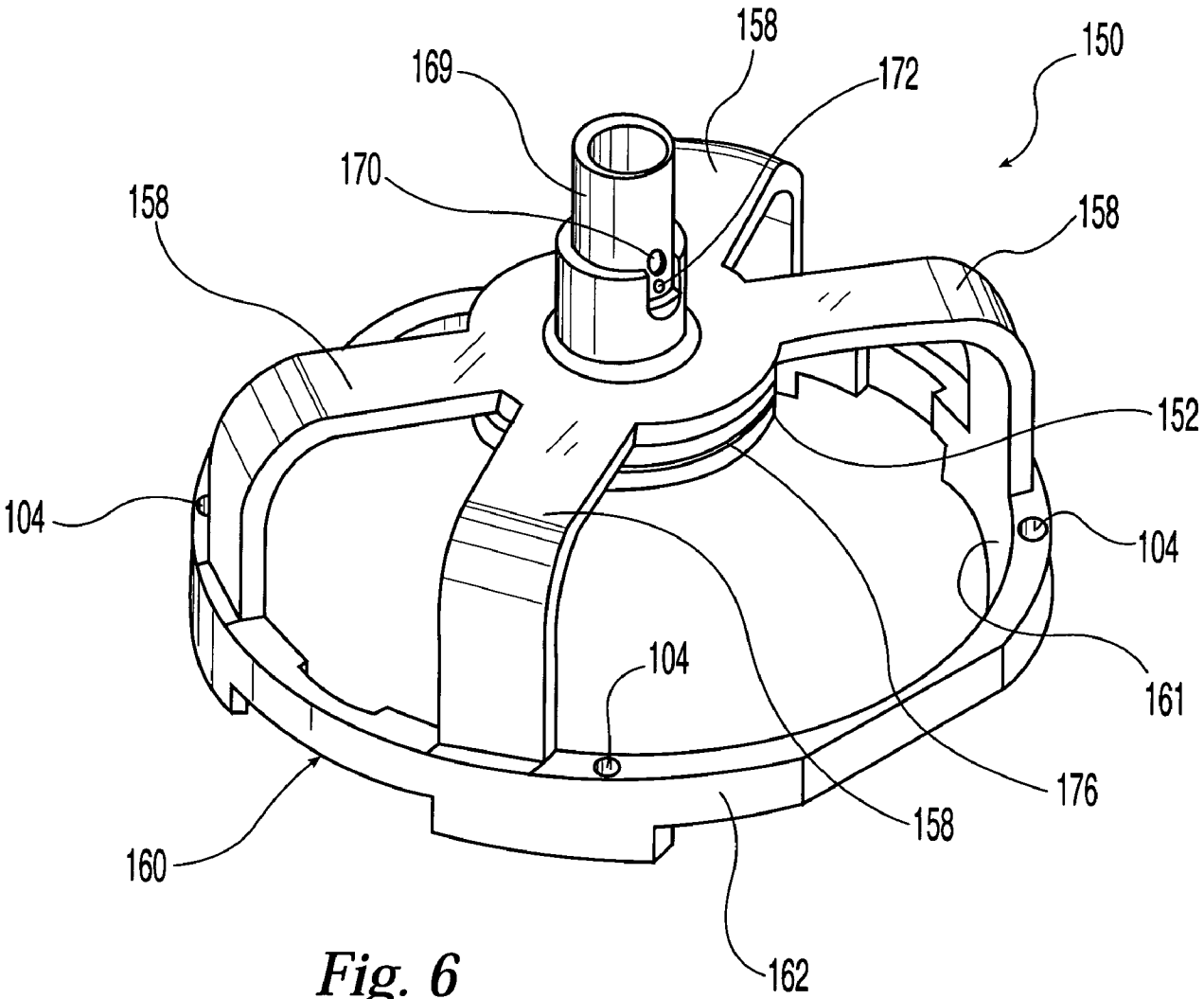
FIG. 6 is a perspective view of one embodiment of an outboard bearing support according to the present invention.
Figure 7:
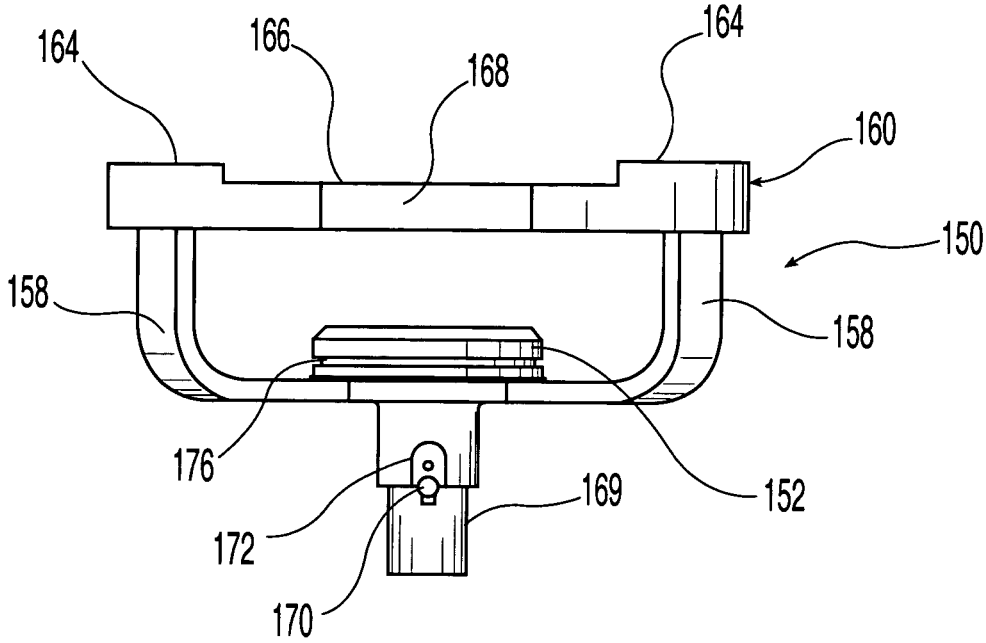
FIG. 7 is a bottom view of the outboard bearing of FIG. 6.
Figure 8:
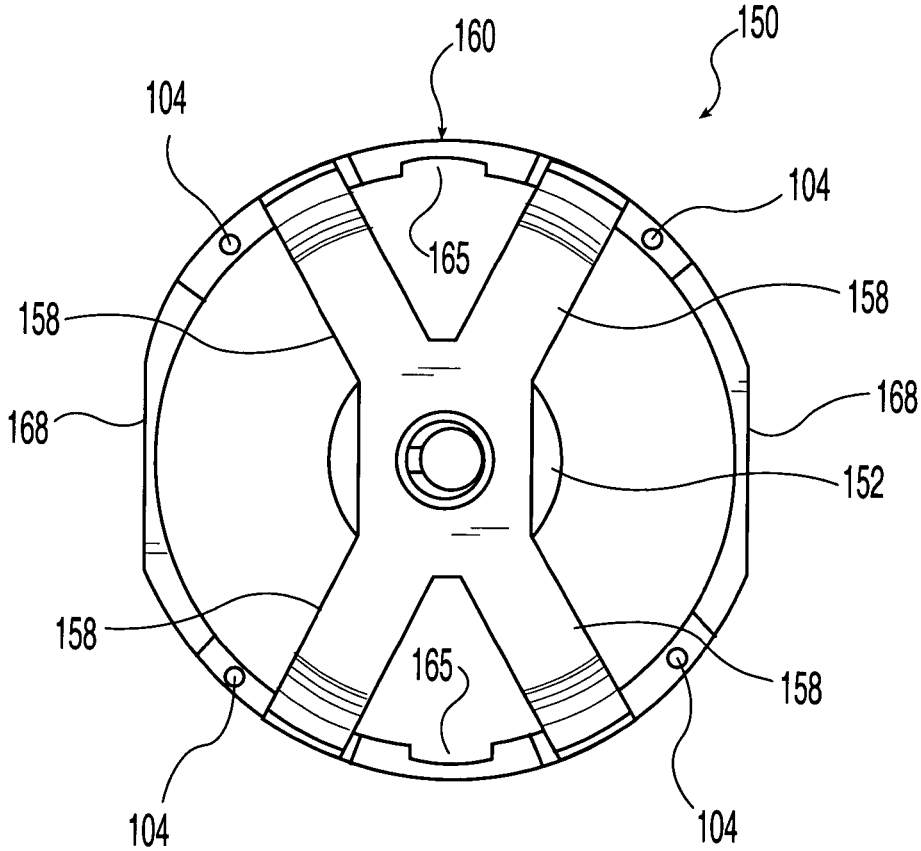
FIG. 8 is a rear view of the outboard bearing of FIG. 6.

Referring back to FIG. 1, compressor 10 is assembled by first attaching compression mechanism 20 to crankcase 64 by inserting bolts 72 through openings 74 in fixed scroll member 22 and engaging bolts 72 in threaded openings 76 in crankcase 64. Referring now to FIGS. 1 and 5, alignment bushings 96 are then fit tightly within the smooth bore portion of holes 100, 102, 104 in crankcase 64, stator 92, and outboard bearing 150 to properly align and locate crankcase 64, stator 92 and outboard bearing 150. Bolts 106 are inserted through holes 104 of outboard bearing 150 and holes 102 in stator 92 and are threaded into tight engagement with threaded holes 100 in legs 66 of crankcase 64.

Figure 12:
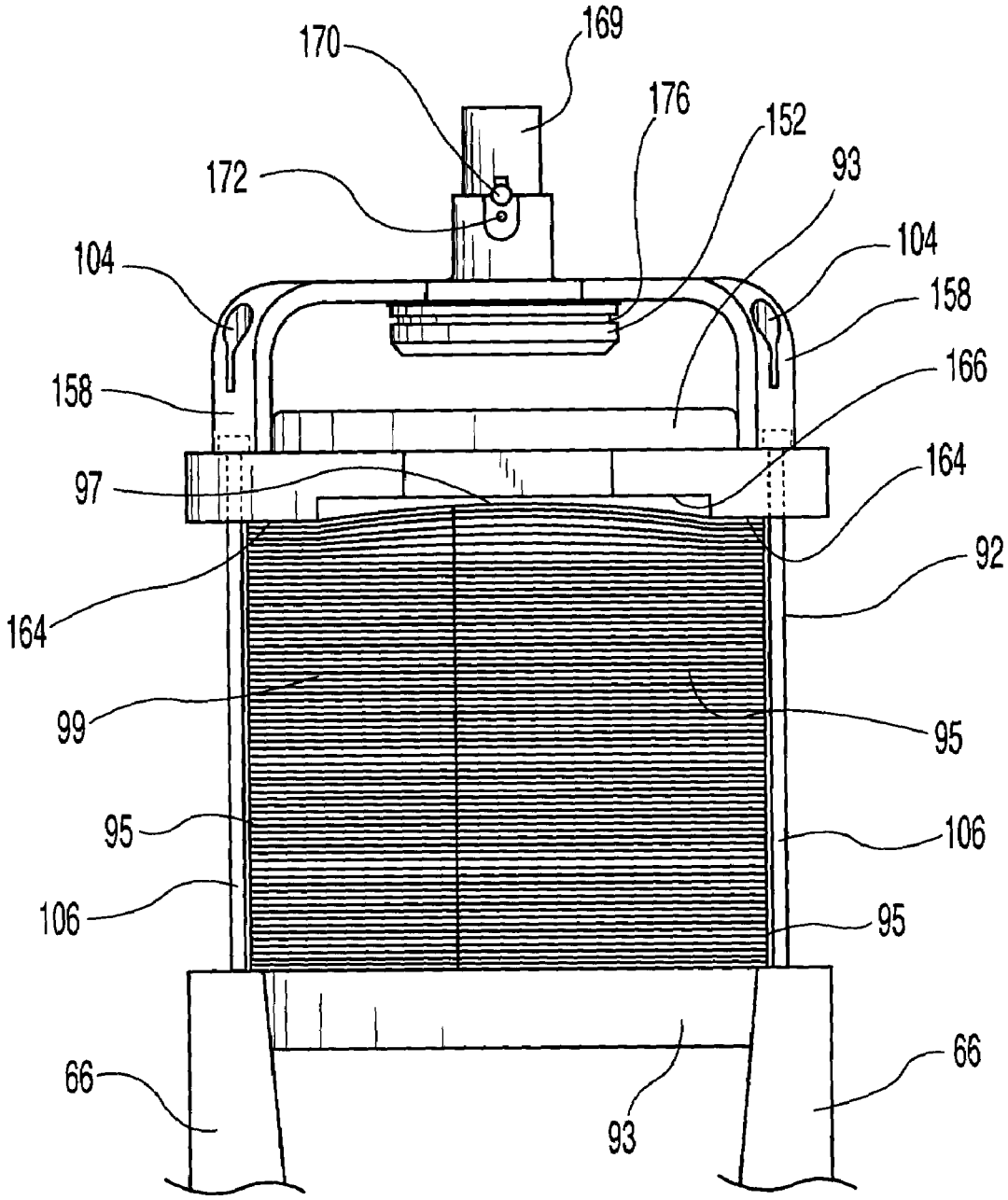
FIG. 12 is a side view of a compressor assembly according to one embodiment of the present invention.

As best seen in FIG. 1, stator core 99 has an exterior surface defined by a series of planar segments rather than cylindrical. By repositioning stator core 99 relative to the openings 104 in outer ring 160, bolts 106 may extend along and be positioned radially outwardly of the exterior of stator core 99 as shown in FIG. 12 instead of extending bolts 106 through openings in stator core 99. As bolts 106 are tightened, ring 160 bears against an end lamination 95 of stator core 99 as shown in FIGS. 2–3. Cylindrical shell 120 of housing 118 is heated and then the compressor-motor assembly is inserted into shell 120. As shell 120 cools, it shrinks to firmly encase the compressor-motor assembly and engage crankcase 64 and outer perimetrical edge 162 of outboard bearing 150. A method of using alignment bushings to assemble a compressor-motor assembly that may be employed with the present invention is described by Skinner in U.S. Provisional Application Ser. No. 60/412,868 entitled COMPRESSOR HAVING ALIGNMENT BUSHINGS AND ASSEMBLY METHOD filed on Sep. 23, 2003, which is hereby incorporated herein by reference. Instead of using bolts 106, alternative methods of securely biasing bearing support 150 against an end of stator core 99 may also be employed with the present invention.

Referring now to FIG. 11, as bolts 106 are tightened, laminations 95 are compressed between crankcase legs 66 and annular face 163 of outboard bearing 150 along the axis of bolts 106. This compression, in turn, may cause deformations such as bulges 97 to appear in the laminations at the end of stator core 99. Deformations 97 are received in recesses 166 of annular face 163, thereby preventing the displacement or distortion of ring 160 and outboard bearing 150. The illustrated deformations 97 have been shown at an exaggerated scale so that the deformations 97 may be clearly seen in the Figures.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a compression mechanism;

a motor including a rotor and a stator, said stator having a plurality of stacked laminations;

a shaft having a first end and an opposite second end, said first end operably coupled to said compression mechanism, said shaft extending through said motor and operably coupled to said rotor, said second end extending outwardly from said motor opposite said compression mechanism; and a bearing support having a central body rotatably supporting said second end of said shaft, an outer ring and a support structure connecting said central body and said outer ring, said outer ring having a plurality of circumferentially distributed contact surfaces lying in a common plane and compressively abutting a first end of said stator and a plurality of recesses positioned between said circumferentially distributed contact surfaces, said contact surfaces causing axially extending bulges to be formed in said plurality of stacked laminations at said first end of said stator, said bulges aligned with and received in said plurality of recesses.

2. The compressor assembly of claim 1 further comprising a plurality of fasteners and wherein said outer ring defines a plurality of holes, said plurality of fasteners extending through said holes and compressively biasing said outer ring against said stator.

3. The compressor assembly of claim 2 further including a crankcase abuttingly engaging said stator opposite said bearing support wherein said bearing support and said crankcase compressively engage said stator therebetween, said fasteners securing said crankcase to said bearing support.

4. The compressor assembly of claim 3 wherein said stator includes a plurality of stator openings in alignment with said plurality of holes, said fasteners extending through said stator openings.

5. The compressor assembly of claim 3 wherein said fasteners are positioned radially outwardly of said stator.

6. The compressor assembly of claim 3 wherein said crankcase rotatably supports said shaft between said compressor mechanism and said motor.

7. The compressor assembly of claim 1 wherein said support structure comprises a plurality of support arms extending from said central body to said outer ring.

8. The compressor assembly of claim 1 further comprising a bearing mounted in said central body and rotatably supporting said shaft.

9. The compressor assembly of claim 1 further comprising a housing defining an interior plenum; said compression mechanism, said motor, said shaft and said bearing support disposed within said interior plenum, a portion of said housing forming a cylindrical wall securely engaged with said outer ring.

10. The compressor assembly of claim 9 wherein said outer ring includes a substantially cylindrical outer perimetrical edge securely engaging said cylindrical wall.

11. The compressor assembly of claim 1 wherein said compression mechanism is a scroll compression mechanism.

12. A method of supporting a shaft in a compressor, said method comprising:

providing a motor having a laminated stator and a rotor;

operably coupling a shaft with said rotor, said shaft having a first end and an opposite second end;

operably coupling a compressor mechanism to the first end of the shaft;

providing a bearing support member having a central body and a plurality of circumferentially distributed contact surfaces lying in a common plane and a plurality of recesses positioned between said circumferentially distributed contact surfaces;

rotatably supporting said shaft within said central body; and compressively engaging one end of said laminated stator with said plurality of circumferentially distributed contact surfaces at least until an axially extending bulge is formed in at least one stator lamination, said bulge aligning with and extending into at least one of said recesses.

13. The method of claim 12 wherein said bearing support supports said second end of said shaft.

14. The method of claim 12 wherein compressively engaging one end of said laminated stator with said plurality of circumferentially distributed contact surfaces further comprises positioning a crankcase against an opposite end of said stator, inserting a plurality of fasteners through said outer ring and engaging said crankcase with said fasteners.

15. The method of claim 14 further comprising rotatably supporting said shaft with said bearing mounted in said crankcase between said motor and said compressor mechanism.

16. The method of claim 12 further comprising disposing said compressor mechanism, motor and bearing support within a housing having a cylindrical wall and wherein said bearing support is mounted within said housing by engaging a radially outer surface of said outer ring with said cylindrical wall.

* * * * *